United States Patent [19]

Nomura

[11] Patent Number: 4,995,292

[45] Date of Patent: Feb. 26, 1991

[54] STRING VIBRATION DETECTING DEVICE FOR ELECTRONIC STRINGED INSTRUMENT

[75] Inventor: Yoshio Nomura, Oome, Japan

[73] Assignee: Casio Computer Co., Ltd., Tokyo, Japan

[21] Appl. No.: 321,737

[22] Filed: Mar. 10, 1989

[30] Foreign Application Priority Data

Mar. 22, 1988 [JP] Japan ..... 63-36411[U]
Sep. 1, 1988 [JP] Japan ..... 63-115211[U]

[51] Int. Cl.[5] ..... G10H 3/18
[52] U.S. Cl. ..... 84/726; 84/743
[58] Field of Search ..... 84/725–729, 84/743

[56] References Cited

U.S. PATENT DOCUMENTS 3,571,483 3/1971 Davidson ..... 84/726
4,236,433 12/1980 Holland ..... 84/726
4,372,187 2/1983 Berg .
4,378,722 4/1983 Isakson ..... 84/726
4,630,520 12/1986 Bonanno .
4,723,468 2/1988 Takabayashi et al. .
4,760,767 8/1988 Tsurubuchi .
4,765,219 8/1988 Alm .

FOREIGN PATENT DOCUMENTS 60-59299 4/1985 Japan .
61-38697 3/1986 Japan .
63-51395 4/1988 Japan .

*Primary Examiner*—Stanley J. Witkowski
*Attorney, Agent, or Firm*—Frishauf, Holtz, Goodman & Woodward

[57] ABSTRACT

Flexible cylindrical magnetic members are detachably attached on one of paired string support units, both of which are mounted on an instrument body to stretch strings therebetween, to face a string-vibration pickup device of an electromagnetic type. A string member is passed through each of the inner holes of the cylindrical magnetic member, and vibrations of the string are picked up by the pickup device through the cylindrical magnetic member to be outputted as electrical signals through the pickup device. Musical sounds are electrically or electronically generated by a sound source responsive to the electrical signals.

14 Claims, 4 Drawing Sheets

STRING VIBRATION DETECTING DEVICE FOR ELECTRONIC STRINGED INSTRUMENT

BACKGROUND OF THE INVENTION

1. Field of the Invention

The present invention relates to an electronic stringed instrument capable of detecting vibrations of strings by means of electromagnetic pickups to electrically or electronically create sounds responsive to the detected vibrations, and particularly to an electric guitar or a guitar synthesizer 2. Description of the Related Art Various kinds of musical instrument have been developed in the past and remarkable progress is now being made relating particularly to electric or electronic stringed instruments.

Electronic stringed instruments which magnetically detect vibrations of strings and create musical sounds responsive to the detected vibrations are disclosed in the following documents.

U.S. Patent Application No. 478,759 filed Feb. 12, 1990 (continuation of U.S. Pat. No. 112,780 filed Oct. 22, 1987, now abandoned); U.S. Pat. No. 184,099 filed Apr. 20, 1988 (now U.S. Pat. No. 4,817,484); and U.S. Pat. No. 256,398 filed Oct. 7, 1988, all of which applications have been assigned to the assignee of the present invention, disclose a guitar synthesizer/electronic guitar using an electromagnetic type pickup device for magnetically detecting vibrations of strings, a pitch extracting device for extracting cycles (or pitches) of the string vibrations from pickup signals generated by the pickup device responsive to the detected vibrations of strings, and a sound-level specifying device for specifying sound levels responsive to pitches extracted by the pitch extracting device.

Further, Japanese Utility Model Disclosure No. 63-51395, the assignee of which is the same as that of the present invention, discloses an electronic stringed instrument using an electromagnetic type pickup device for magnetically detecting vibrations of strings, an envelope detecting device for detecting envelope signals from those pickup signals which are generated by the pickup device responsive to the vibrations of detected strings, and a peak measuring device for measuring peaks of the envelope signals detected by the envelope detecting device. The peak of envelope signal represents the strength of force by which the string is flipped, and it is used to control the volume of musical sounds created by a sound source in response to the vibration of strings.

Furthermore, U.S. Pat. No. 4,723,468 discloses an electronic guitar/guitar synthesizer using an electromagnetic type pickup device for detecting vibrations of strings, and a fret-position detecting device for detecting a string-pressing position on a finger board by using ultrasonic signal generated by the pickup device represents the state of the vibrating string, and it is used to specify start and finish of musical sounds created by a sound source in response to the vibration of strings and to control the volume of the musical sounds.

Still further, U.S. Pat. Nos. 4,372,187, 4,760,767 and 4,630,520 disclose an electronic guitar using an electromagnetic type pickup device for magnetically detecting vibrations of strings to output pickup signals responsive to the vibrations of detected strings, and a fret-position detecting device for electrically detecting contact positions of a pressed conductive string at which the pressed string contacts a plurality of frets on a finger board. A pickup signal generated by the pickup device represents the state of the vibrating string, and it is used to specify start and finish of musical sounds created by a sound source in response to the vibration of strings and to control the volume of the musical sounds.

Still further, U.S. Pat. No. 4,765,219 discloses an electronic violin using a pickup device for magnetically detecting vibrations of strings to generate pickup signals responsive to the vibrations of detected strings.

In the case of the above-mentioned electronic stringed instruments, material of strings must have magnetism to enable the electromagnetic type pickup device to detect vibrations of strings as electric signals, and steel, for example, is used as the material of strings. In the case of these stringed instrument, therefore, non-magnetic strings, such as silk, nylon, gut or the like, used in acoustic guitars and being capable of creating unique tone colors cannot be used.

Japanese Utility Model Disclosure No. 61-38697 discloses a proposal to solve the above described problem. In this proposal, a magnetic paint made by mixing a magnetic powder such as iron oxide powder or mixture of the magnetic powder with a painting agent such as synthetic resin paint, is painted on a part of the nonmagnetic string. This proposal, however, does not make it possible to use those non-magnetic strings, which are not coated with the magnetic paint but which are commonly on the market, when any of the strings coated with the magnetic paint is broken. This makes it necessary for players to carry the strings coated with the magnetic paint as spares. When the special strings are not be carried, it will take much time to get a string coated with the magnetic paint. In addition, since the magnetic paint is only partially applied to the string, the string must be stretched on the body unit of the instrument in such a way that its magnetic-paint-coated area is opposed to the corresponding pickup, thereby making the strings stretching operation troublesome. Further, the magnetic paint is likely to peel off.

SUMMARY OF THE INVENTION

The present invention has been made in consideration of the above situation and has its first object to provide an electronic stringed instrument capable of using various kinds of strings (including those of the non-magnetic type) easily available and commonly used while making the strings stretching operation easier and enhancing the durability of the strings.

A second object of the present invention is to allow easy maintenance of a construction of the electronic stringed instrument, constructed to achieve the above first object.

The first object of the present invention can be achieved by an electronic stringed instrument comprising a pair of string support units arranged on a body unit at a certain interval; at least one string member stretched between the paired string support units; a cylindrical magnetic member into which said string member is passed, one end of which is detachably attached to at least one of said paired string support units while the other end portion thereof covers the string member, and which has such flexibility as can follow any movement of said string member; and a string vibration detecting means of the electromagnetic type positioned to face the magnetic member.

Even if non-magnetic strings made of such as nylon or the like are used in this electronic stringed instrument, vibrations of the non-magnetic strings produced by flipping the strings can be picked up as electric signals by the electromagnetic type string vibration detecting means through the flexible cylindrical magnetic members.

In the electronic stringed instrument of the present invention, in order to achieve the second object at least one of the string support units described above includes a body detachably attached to said body unit, a string supporting portion formed on the body to support one end of the string member and allowing the magnetic member to be detachably attached thereon, a fixing portion for cooperating with the string supporting portion to fix the one end of the string member, and a string guide member having a string guide hole for guiding the string member into the inner hole of the cylindrical magnetic member.

These and other objects as well as merits of the present invention will become apparent from the following detailed description with reference to the accompanying drawings.

DETAILED DESCRIPTION OF THE PREFERRED EMBODIMENT

Various embodiments of the present invention will be described in detail with reference to the accompanying drawings.

Figure 1:
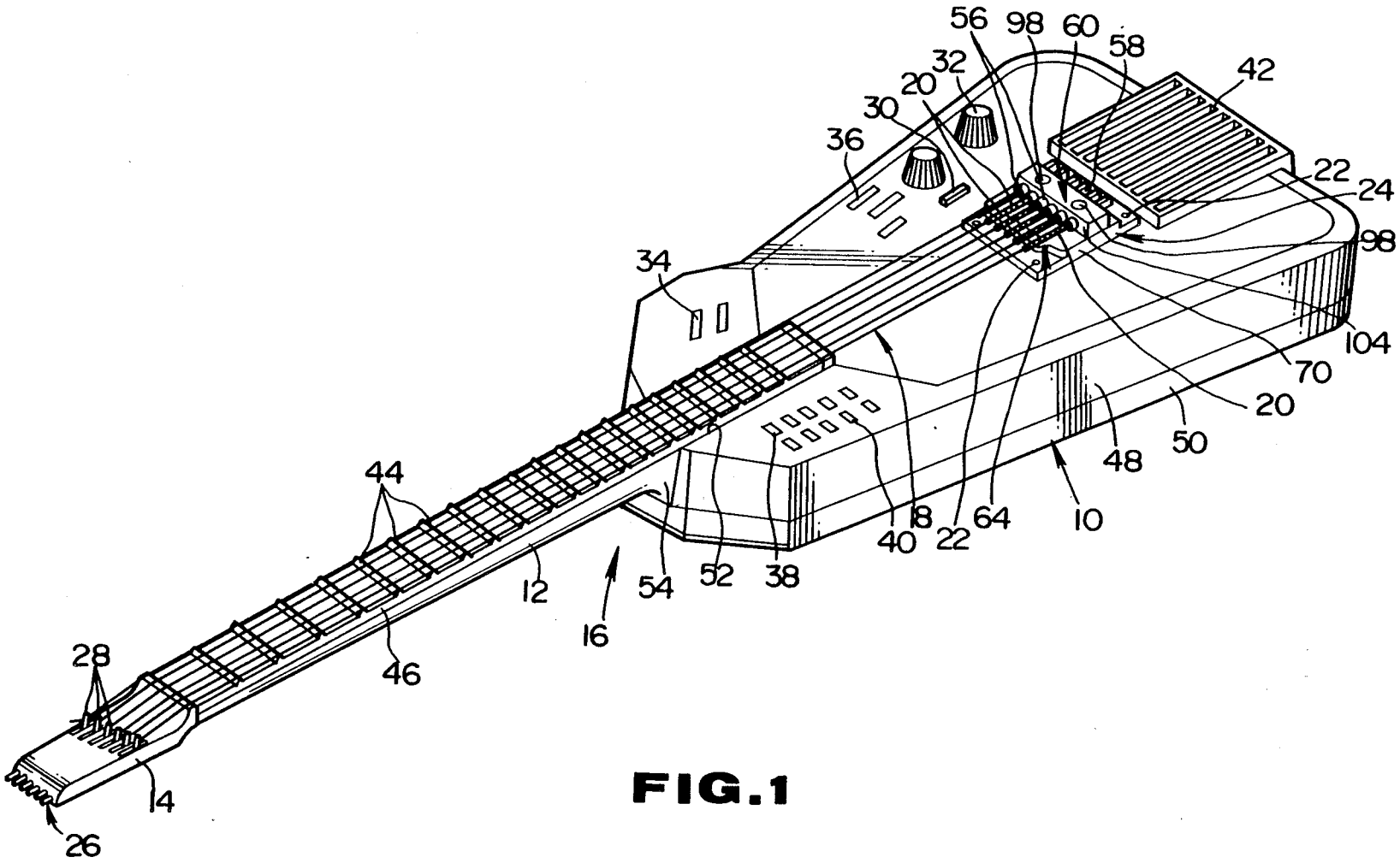
FIG. 1 is a perspective view schematically showing the whole of an electronic guitar as an electronic stringed instrument to which the present invention is applied.
Figure 2:
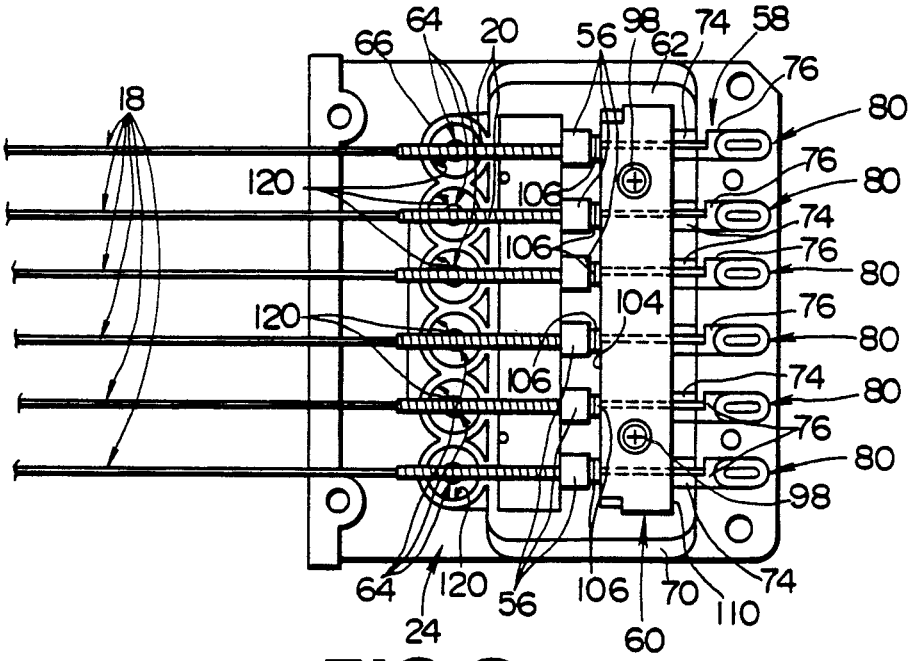
FIG. 2 is an enlarged plan view schematically showing a string support unit of the electronic guitar and its vicinity, magnetic members and a string vibration detecting means being mounted on the unit.
Figure 3:
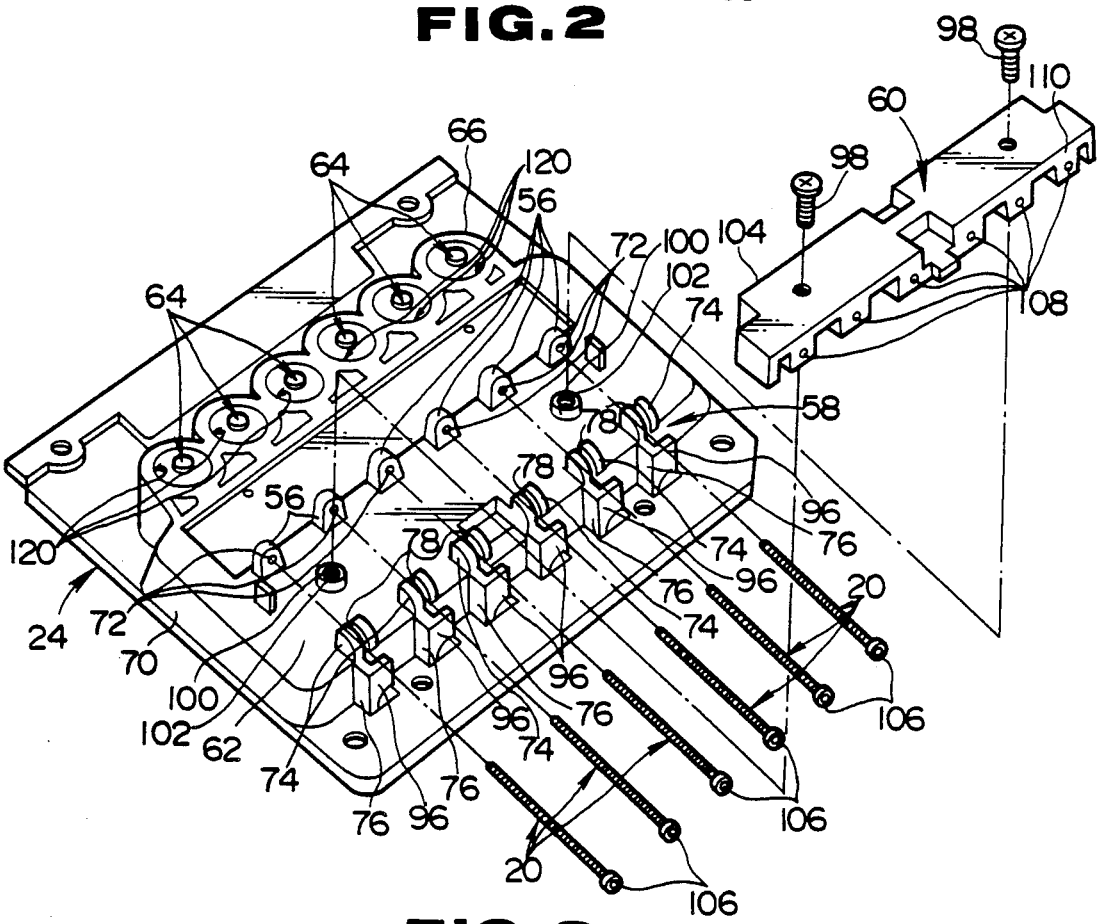
FIG. 3 is a perspective view schematically showing the string support unit in a dismantled state.

FIG. 1 shows an electronic stringed instrument of the string trigger type to which the present invention is applied.

The electronic stringed instrument shown in FIG. 1 has a guitar shape. Body unit 16 comprises body 10, neck 12, and head 14, and 6 nylon strings 18 are stretched along neck 12 to be parallel to one another on body unit 16 between body 10 and head 14. One end of each of nylon strings 18 located on the body side is passed through the inner hole of coil spring 20 which is a cylindrical magnetic member having a flexibility and then fixed on string support unit 24 detachably attached on body 10 at the center but rear side thereof by means of a plurality of bolts 22. The other end of each of nylon strings 18 located on the head side is fixed to its corresponding string-fixing pin 28 of string-tension adjusting system 26 which is fixed on an upper surface of head 14 to serve as another string support unit.

Various kinds of switches such as power source on-off switch 30, volume switch 32. mute switch 34, pat operating switch 36, rhythm selection switch 38 and sound color selection switch 40 are arranged on the upper surface of body 10, while a circuit board, speaker 42 and the like are housed in body 10. A finger board 46 with which a plurality of frets 44 are integrally formed is mounted on an upper surface of neck 12.

Body unit 16 is constructed by combining of a plurality of components formed of synthetic resin respectively. In this embodiment, body 10 and neck 12 with head 14 are formed independently of each other. Body 10 is further constructed by upper and lower halves 48 and 50 which are formed independently of each other. These halves 48 and 50 are combined together by means of bolts (not shown). Neck 12 including head 14 is combined with body 10 by means of bolts (not shown) after its base 54 which is opposite to its head 14 is fitted into groove 52 on the top of body 10 substantially at the center but front side thereof.

Figure 4:
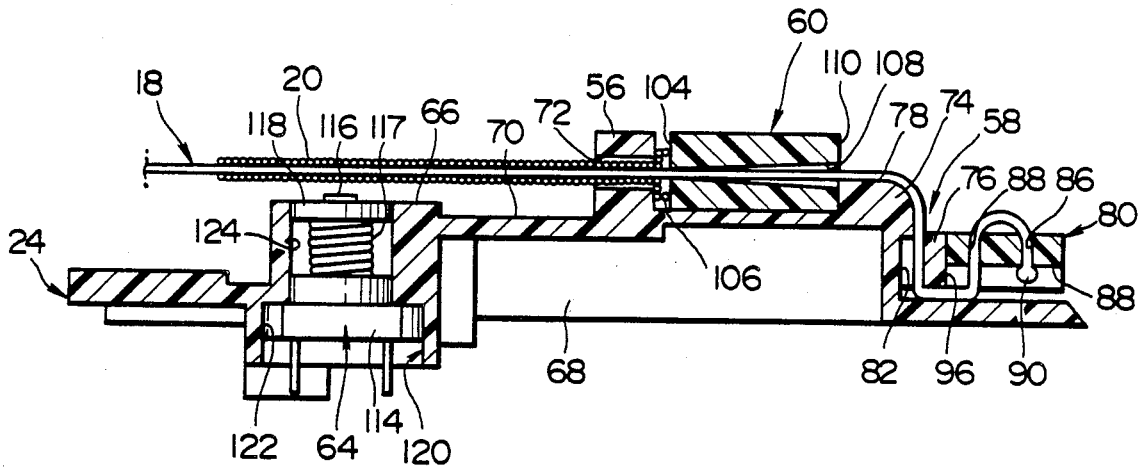
FIG. 4 is a vertically-sectional view schematically showing the string support unit.
Figure 5:
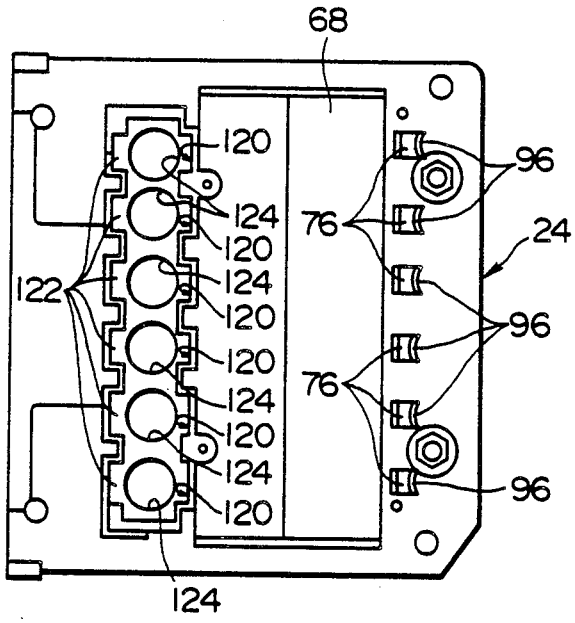
FIG. 5 is a lower side view schematically showing the lower surface of the string support unit.
Figure 6:
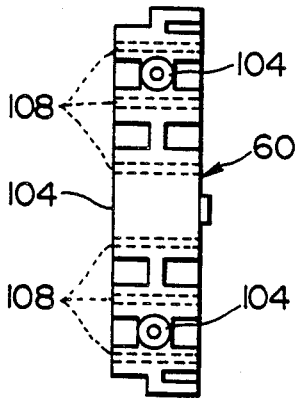
FIG. 6 is a lower side view schematically showing the lower surface of a string guide member attached to the string support unit.

Strings support unit 24 is made of synthetic resin, and string supporting portion 56, string fixing portion 58, string-guide-member attaching portion 62 for string guide member 60, and electromagnetic pickup attaching portion 66 for electromagnetic pickup 64 as a string vibration detecting means are formed on the upper surface of string support unit 24, as shown in FIGS. 2 through 6. As shown in FIGS. 4 and 5, a circuit-board attaching indentation 68 for the circuit board (not shown) is formed on the lower surface of string support unit 24.

Upwardly projecting table 70 is formed on the upper surface of string support unit 24 so as to correspond to indentation 68 of the lower surface of support unit 24. String supporting portions 56 are formed on the upper surface of string support unit 24 at the center of table 70 in the longitudinal direction of body unit 16, and under which space 68 is defined, so as to correspond to a plurality of strings 18. Each of string supporting portions 56 has a horizontally extending through-hole 72. Coil spring 20 is inserted into each of through-holes 72, and string 18 is passed through the inner hole of coil spring 20.

String fixing portion 58 is located at the rear end of table 70, and is constructed by string guides 74 formed on the upper surface of table 70 so as to correspond to a plurality of strings 18, and string hooks 76 continuously formed on the rear end of string guides 74. String hooks 76 are formed on a rising face of a rear end step of table 70 and these string hooks 76 prevent strings support unit 24 made of synthetic resin from being deformed by tension of strings. Substantially arc-like guide groove 78 is formed on the upper surface of each of string guides 74, and it guides string 18, which horizontally extends from through-hole 72 of each of string supporting portion 56, downward by about 90°. String hooks 76 are used as engaged portions with which one end of nylon strings 18 are engaged, and they are also used to be engaged with string stopper members 80 fixed to those ends of nylon strings 18. Each string hook 76 has at its side surface vertically extending groove 82 (see FIG. 4). Nylon string 18 guided downward by string guide 74 extends in groove 82, and one end of string 18 is guided out from the lower end of groove 82 to extend along the rear end portion of the upper surface of string support unit 24.

Figure 7:
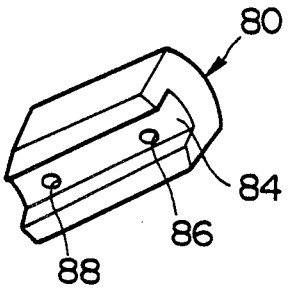
FIG. 7 is a perspective view schematically showing a lower surface of a string stopper member attached to one end of the string.

String stopper members 80 are made of synthetic resin and each of them is formed to have a plan shape substantially like a running track, as shown in FIG. 7. Groove 84 is formed on the lower surface of string stopper member 80 at the center thereof to extend along its longitudinal direction, and two through-holes 86 and 88 are formed in groove 84 to be parallel to each other and to extend to the upper surface of string stopper member 80.

Figure 8:
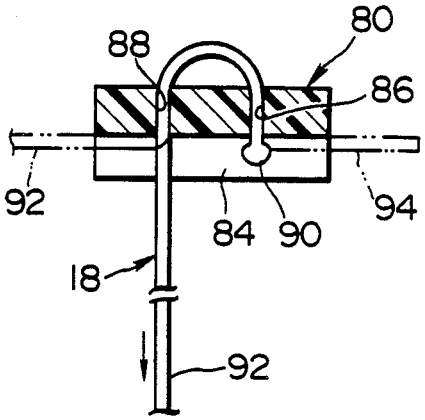
FIG. 8 is a sectional view schematically showing the manner of attaching one end of the string to the string stopper member.

FIG. 8 shows a manner of fixing one or base end of nylon string 18 to string stopper member 80. The other or free end of nylon string 18 on which no ball end 90 is formed is passed through hole 86 from groove 84 and then is bent like the letter "U" to pass through the other hole 88 from the upper surface of string stopper member 80. The free end of nylon string 18 which has been passed through holes 86 and 88 of string stopper member 80 in this manner is pulled relative to string stopper member 80 until its ball end 90 is located in groove 84 of string stopper member 80. When free-end extending portion 92 of nylon string 18 is bent to extend in a direction along groove 84 as shown by two-dot chain line in FIG. 8, string stopper member 80 is reliably fixed to ball end 90 of nylon string 18 by friction.

Even if a case where nylon string 18 has no ball end 90, string stopper member 80 can be reliably fixed to the base end of string 18 the same as in the case where string 18 has ball end 90, provided that the extending distance of a ball-free base end 94 of string 18 from through-hole 86 into groove 84 is increased, and longextended ball-free end 94 is bent to extend along the bottom of groove 84 as shown by two-dot chain line in FIG. 8.

A knot made on ball-free base end 94 of string 18 can function in the same as ball end 90.

Free-end extending portion 92 of each of nylon strings 18 is passed upward through vertical groove 82 of hook 76 and is caused to extend along guide groove 78 of string guide 74. At this time, if free-end extending portion 92 of nylon string 18 is horizontally pulled, string stopper member 80 is pressed against curved rear end surface 96 of string hook 76 at its arc-like one end surface with its groove 84 directed downward. As apparent from the above description, pulling force applied to free-end extending portion 92 of nylon string 18 is resisted by the frictional force of nylon string 18 against guide groove 78 of string guide 74 and the lower end of vertical groove 82 of string hook 76 and also by the engagement of string stopper member 80 with curved rear end surface 96 of string hook 76. This is preferable because the force of fixing slippery nylon string 18 can be increased.

String guide member 60 serves to fix coil springs 20 through which nylon strings 18 are passed and which are supported in through-holes 72 of string supporting portions 56, and it also serves as a string guide for guiding free-end extending portion 92 of each of nylon strings 18 into corresponding coil springs 20. String guide member 60 is made of synthetic resin to have a rectangular pole shape, and is detachably attached to string-guide-member attaching portion 62, which is positioned on table 70 of string support unit 24 between string supporting portions 56 and string fixing portion 58, by means of a plurality of bolts 98.

Bolts 98 are screwed into screw holes 102 in bosses 100 formed at string-guide-member attaching portion 62 while bosses 100 are engaged with spot facings 104 (see FIG. 6) on the lower surface of string guide member 60 to cause string guide member 60 to be positioned at string-guide-member attaching portion 62.

String guide member 60 which has been attached to attaching portion 62 at its predetermined position fixes coil springs 20 to their corresponding string supporting portions 56 in such a way that front end surface (facing surface) 104 of string guide member 60 which faces string supporting portions 56 presses largediameter engaging portions 106 of coil springs 20, which are formed at the projecting ends of coil springs 20 projected from the string-fixing-side ends of through-holes 72 of string supporting portions 56, against the rear end surfaces of string supporting portions 56, as shown in FIG. 4. String guide member 60 is provided with a plurality of string guide holes 108 so as to be aligned with the center lines of coil springs 20 which are passed through through-holes 72 of string supporting portions 56 when string guide member 60 is attached on corresponding attaching portions 62. Each of string guide holes 108 passes through string guide member 60 from front end surface (facing surface) 104 to rear end surface (opposing surface) 110, and it is tapered to have a large opening at rear end surface 110 the diameter of which is larger than that of nylon string 18 and a small opening at front end surface 104 the diameter of which is substantially the same as that of nylon string 18.

When free-end extending portion 92 of each of nylon strings 18 extending from guide grooves 78 of string guides 74 of string fixing portion 58 is inserted into string guide hole 108 of string guide member 60 from the rear-end-surface side opening thereof, it can be quickly and easily introduced into the inner hole of coil spring 20, although the inner hole of coil spring 20 is extremely small in diameter, because string guide hole 108 is tapered as described above. Free-end extending portion 92 of each of nylon strings 18 passing through coil springs 20 extends toward head 14 on finger board 46 of neck 12, and it is connected to its corresponding string-fixing pin 28 of string-tension adjusting system 26 on head 14. The tension of each of strings 18 stretched between string support unit 24 on body 10 of body unit 16 and system 26 as another string support unit on head 14 can be adjusted by string-tension adjusting system 26 to create a desired musical interval.

Figure 9:
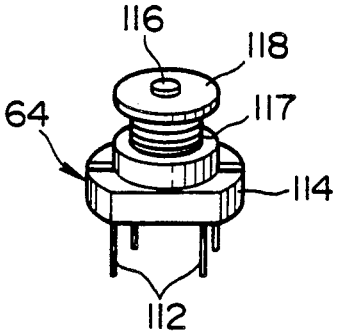
FIG. 9 is a perspective view schematically showing an electromagnetic pickup as the string vibration detecting means.

Each of electromagnetic pickups 64 includes holder 114 having a plurality of output terminals 112 projecting downward from the lower surface of holder 114, iron core 116 attached to the upper surface of holder 114, and coil bobbin 118 on which coil 117 is wound and which is mounted on iron core 116, as shown in detail in FIG. 9. A plurality of attachment holes 120 are formed in table 70 of string support unit 24 at electromagnetic-pickup attaching portion 66 so as to face a plurality of coil springs 20 on the plurality of strings 18 stretched between string support unit 24 and string tension adjusting system 26 on body unit 16. Each of holes 120 is a stepped one having large-diameter portion 122 opened at the lower surface of string support unit 24 and small-diameter portion 124 opened at the upper surface thereof, as shown in FIGS. 4 and 5. Each of electromagnetic pickups 64 is fitted into hole 120 from the lower surface side of string support unit 24 with its electromagnet, which consist of iron core 116 and coil bobbin 118, being positioned in upper small-diameter portion 124 while holder 114 is positioned in lower large-diameter portion 122. Since electromagnetic pickups 64 are attached in a predetermined pattern on the circuit board (not shown) which is housed in indentation 68 of the lower surface of string support unit 24 (see FIG. 5), electromagnetic pickups 64 are automatically fitted into corresponding holes 120 when the circuit board is attached in indentation 68.

When vibrations of coil springs 20 caused by vibrations of flipped nylon strings 18 change the strength of magnetic fluxes generated from corresponding electromagnets of electromagnetic pickups 64, induced electric potentials are caused by the change of the magnetic fluxes and these potentials are detected as electric signals representing the vibrations of strings 18. The circuit board (not shown) has electronic parts for outputting the electric signals, which have voltage levels larger than the predetermined value, as string triggers, to a musical sound generating circuit as a sound source housed in body 10 to create musical sound signals, when voltage levels of these electric signals generated from electromagnetic pickups 64 are larger than a predetermined value.

It should be understood that the above-described embodiment is intended only to explain the present invention and that the present invention is not limited to this embodiment. It should be understood therefore that various changes and modifications can be made without departing from the spirit and scope of the present invention.

For example, electromagnetic pickups 64 may be arranged directly on the upper surface of body 10 of body unit 16.

Further, other non-magnetic strings such as ones made of silk, gut and the like may be used instead of the nylon string, and magnetic strings such as ones made of steel and the like can be used, as a matter of course.

Figure 10:
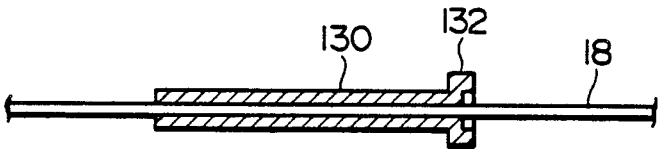
FIG. 10 is a vertically-sectional view schematically showing another example of the cylindrical magnetic member with the string passed through in the magnetic member.

Furthermore, a cylindrical magnetic tube 130 made by magnetic material, which is a mixture of flexible plastics or rubber and magnetic powder, may be used in stead of coil spring 20, as shown in FIG. 10. Each of magnetic tubes 130 also has large-diameter portion 132 at one end thereof.

Still further, the present invention may be applied to electronic stringed instruments of the pitch pickup and ultrasonic types.

What is claimed is:

1. A string vibration detecting device for an electronic stringed instrument, comprising:

a pair of string support units arranged on a body unit at a certain interval;

at least one stringed member stretched between the pair of string support units;

a cylindrical magnetic member into which said string member is passed, one end of which is mounted removably to at least one of said pair of string support units while the other end portion thereof covers the outer periphery of the string member, the cylindrical magnetic member having such flexibility as to follow any movement of said string member; and string vibration detecting means of the electromagnetic type positioned operatively to face the cylindrical magnetic member for detecting movement of the cylindrical magnetic member.

2. The electronic stringed instrument according to claim 1, wherein said cylindrical magnetic member is made by turning a wire rod of magnetic material in a coil shape.

3. The electronic stringed instrument according to claim 1, wherein said cylindrical magnetic member is a tube made of flexible magnetic material.

4. The electronic stringed instrument according to claim 1, wherein said cylindrical string member is made of either magnetic or non-magnetic material.

5. The electronic stringed instrument according to claim 1, wherein said magnetic member has an engaging portion at its one end to engage with at east one of the string support units.

6. The electronic stringed instrument according to claim 5, wherein at least one of said string support units to which said cylindrical magnetic member is attached has a through-hole through which said magnetic member is passed, and an engaged portion which is engaged with the engaging portion of one end of said cylindrical magnetic member as passed through the through-hole.

7. The electronic stringed instrument according to claim 6, wherein the outer diameter of the engaged portion of said cylindrical magnetic member is larger than the inner diameter of the through-hole.

8. The electronic stringed instrument according to claim 1, wherein at least one of the string support units to which said cylindrical magnetic member is attached has a body detachably attached to said body unit, a string supporting portion formed on the body to support one end of the string member and allowing the magnetic member to be detachably attached thereon, a string guide having a fixing portion for cooperating with the string supporting portion to fix the one end of the string member, and a string guide member having a string guide hole for guiding the string member into the inner hole of the cylindrical magnetic member to cause the string member to pass through the cylindrical magnetic member.

9. The electronic stringed instrument according to claim 8, wherein said string guide member is detachable from the body of said string support unit.

10. The electronic stringed instrument according to claim 8, wherein the string guide hole is formed in the string guide member so as to face a cylindrical magnetic member attaching position in the string supporting position.

11. The electronic stringed instrument according to claim 8, wherein said string guide member has a facing surface facing the string supporting portion and an opposing surface oriented in the opposite direction of the facing surface, and the string guide hole is a through-hole passing through the string guide member from its facing surface to its opposing surface.

12. The electronic stringed instrument according to claim 11, wherein the inner diameter of the string guide hole in the string guide member becomes gradually larger and larger in a direction from the facing surface to the opposing surface of the string guide member.

13. The electronic stringed instrument according to claim 1, wherein, at least one of said string support units to which said cylindrical magnetic member is attached has a string supporting portion facing said cylindrical magnetic member and supporting one end of said string member, and said string vibration detecting means is attached to the string supporting portion.

14. A string vibration detecting device for an electronic stringed instrument, comprising:

a string support unit arranged on an instrument body unit;

at least one string member supported by said string support unit;

a cylindrical member for covering at least a portion of an outer surface of said string member to follow vibrating movement of said string member, one end portion of said cylindrical member being detachably mounted to said string support unit, and said cylindrical member being made of such a material that its movement can be detected electro-magnetically and string vibration detecting means arranged on said instrument body unit in operative relation with the cylindrical member, for electro-magnetically detecting vibration of said cylindrical member.

* * * * *

UNITED STATES PATENT AND TRADEMARK OFFICE

CERTIFICATE OF CORRECTION

PATENT NO. : 4,995,292

DATED : February 26, 1991

INVENTOR(S) : Yoshio NOMURA

It is certified that error appears in the above-identified patent and that said Letters Patent is hereby corrected as shown below:

Title page, Section [75] Inventor:

The address of the inventor should read:

--Tokyo, Japan--

Signed and Sealed this

Twenty-second Day of December, 1992

*Attest:*

DOUGLAS B. COMER

*Attesting Officer*

*Acting Commissioner of Patents and Trademarks*